US008960865B2

(12) United States Patent
Miyazawa

(10) Patent No.: US 8,960,865 B2
(45) Date of Patent: Feb. 24, 2015

(54) LIQUID DROPLET EJECTING HEAD AND PRINTING APPARATUS

(71) Applicant: Seiko Epson Corporation, Tokyo (JP)

(72) Inventor: Ikuya Miyazawa, Sakata (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/030,472

(22) Filed: Sep. 18, 2013

(65) Prior Publication Data

US 2014/0085384 A1 Mar. 27, 2014

(30) Foreign Application Priority Data

Sep. 27, 2012 (JP) ..... 2012-213714

(51) Int. Cl.
*B41J 2/05* (2006.01)
*B41J 2/045* (2006.01)
*B41J 2/14* (2006.01)

(52) U.S. Cl.
CPC ..... *B41J 2/04501* (2013.01); *B41J 2/14233* (2013.01); *B41J 2002/14491* (2013.01)
USPC ..... 347/59

(58) Field of Classification Search
CPC .. B41J 2/14; B41J 2/1623; B41J 2002/14362; B41J 2002/14491; B41J 2/14072; B41J 2/04501
USPC ..... 347/20, 54, 56, 59, 68
See application file for complete search history.

(56) References Cited

U.S. PATENT DOCUMENTS 7,527,356 B2 * 5/2009 Sato ..... 347/50
2006/0234534 A1 10/2006 Sato

FOREIGN PATENT DOCUMENTS

JP 2006-281763 10/2006
JP 2007-136711 6/2007
JP 2011-136462 7/2011

* cited by examiner

*Primary Examiner* — An Do
(74) *Attorney, Agent, or Firm* — Workman Nydegger

(57) ABSTRACT

A liquid droplet ejecting head includes: a base substrate that is formed as a plate-like body and that has a concave portion, which is formed to be open toward an upper surface of the plate-like body, and a wiring pattern which is provided inside the concave portion and formed of a conductive material; and an IC package that is fixed to airtightly seal the inside of the concave portion on the upper surface side and is electrically connected to the wiring pattern.

16 Claims, 3 Drawing Sheets

LIQUID DROPLET EJECTING HEAD AND PRINTING APPARATUS

The entire disclosure of Japanese Patent Application No. 2012-213714, filed Sep. 27, 2012 is expressly incorporated by reference herein.

BACKGROUND

1. Technical Field

The present invention relates to a liquid droplet ejecting head, and a printing apparatus.

2. Related Art

For example, to perform printing on a printing medium such as a printing paper, a printing apparatus, which has a liquid droplet ejecting head, is used (for example, refer to JP-A-2006-281763).

JP-A-2006-281763 discloses a liquid droplet ejecting head including: a cavity that temporarily stores an ink; and a base substrate that has an ejection port. The ejection port communicates with the cavity so as to eject the ink within the cavity as liquid droplets. Further, a piezoelectric element is disposed to be adjacent to the cavity. The piezoelectric element is electrically connected to a driver IC through a wiring pattern. The driver IC controls driving of the piezoelectric element. Then, by driving the piezoelectric element, it is possible to reliably eject ink droplets from the ejection port.

Further, in the liquid droplet ejecting head disclosed in JP-A-2006-281763, the concave portion is formed to be open toward the upper surface of the base substrate. The wiring pattern is disposed inside the concave portion. In addition, the driver IC is embedded near the outside of the concave portion of the base substrate.

However, in the liquid droplet ejecting head, it is necessary to protect (isolate) the wiring pattern from the outside (external air). For the protection, for example, a member (driving unit in JP-A-2006-281763), which functions as a cover for covering the concave portion, may be provided, or the wiring pattern may be coated. In the former case, since the member is provided, the number of components constituting the liquid droplet ejecting head increases, and the structure of the liquid droplet ejecting head becomes complex. In contrast, in the latter case, there is laborious work to perform the coating, or there is a problem in that the migration effect occurs.

SUMMARY

An advantage of some aspects of the invention is to provide a liquid droplet ejecting head capable of isolating a wiring pattern, which is provided inside a concave portion of a base substrate, from the outside with a simple structure, and to provide a printing apparatus having the liquid droplet ejecting head.

An aspect of the invention is directed to a liquid droplet ejecting head including: a base substrate that is formed as a plate-like body and that has a concave portion, which is formed to be open toward one surface of the plate-like body, and a wiring pattern which is provided inside the concave portion and formed of a conductive material; and an IC package that is electrically connected to the wiring pattern, in which the IC package seals and fixes the concave portion on the one surface side.

With this configuration, it is possible to reliably prevent, for example, not only moisture (vapor) but also grit and dust from entering into the concave portion of the base substrate from the outside. Accordingly, it is possible to reliably isolate and protect the wiring pattern, which is provided inside the concave portion, from the outside. As a result, it is possible to prevent corrosion, deterioration, and the like of the wiring pattern.

Further, the IC package also functions as a sealing member that seals the inside of the concave portion of the base substrate. Therefore, it is possible to omit a separate sealing member. Consequently, it is possible to simplify the structure of the liquid droplet ejecting head.

In the liquid droplet ejecting head of the aspect of the invention, it is preferable that the IC package is formed in a chip shape, and has a size capable of covering the concave portion in plan view.

With this configuration, it is possible to more reliably prevent, for example, moisture and the like from entering into the concave portion of the base substrate from the outside. Consequently, it is possible to more reliably protect the wiring pattern.

In the liquid droplet ejecting head of the aspect of the invention, it is preferable that the IC package is fixed onto the base substrate through an adhesive, and a gap between one surface of the base substrate and one surface of the IC package is filled with the adhesive.

With this configuration, the gap between the IC package and the base substrate can be reliably filled. Consequently, it is possible to more reliably airtightly seal the inside of the concave portion of the base substrate.

In the liquid droplet ejecting head of the aspect of the invention, it is preferable that the concave portion is formed in a shape of a channel, and has a bottom portion and a pair of side wall portions which stand on the bottom portion so as to be opposed to each other in a width direction of the channel.

With this configuration, when the wiring pattern is formed of linear objects, the concave portion is formed in the shape of the channel, whereby the multiple linear objects are arranged along the length direction. Consequently, the IC package, which is capable of transmitting and receiving a large volume of information through the linear objects, can be mounted.

In the liquid droplet ejecting head of the aspect of the invention, it is preferable that the side wall portions are inclined such that a separation distance between the side wall portions gradually increases toward the one surface side.

With this configuration, for example, when the concave portion is formed by etching the base substrate, the side wall portions are formed to be inclined. Thereby, it is possible to easily and reliably perform the formation.

In the liquid droplet ejecting head of the aspect of the invention, it is preferable that the wiring pattern is formed of a plurality of linear objects formed to extend from the one surface to the bottom portion along directions of inclination of the side wall portions.

With this configuration, the IC package, which is capable of transmitting and receiving a large volume of information through the linear objects, can be mounted on the base substrate.

In the liquid droplet ejecting head of the aspect of the invention, it is preferable that the base substrate has an ejection port, which is formed to be open toward the other surface of the plate-like body and ejects liquid droplets, and a piezoelectric element which causes the liquid droplets to be ejected from the ejection port, and the IC package are electrically connected to the piezoelectric element through the wiring pattern so as to control an operation of the piezoelectric element.

With this configuration, for example, it is possible to precisely and reliably control the ejection conditions such as an amount of ejected liquid droplets and ejection timing (ejection and stop of the ejection).

In the liquid droplet ejecting head of the aspect of the invention, it is preferable that the base substrate is formed as a laminated body.

With this configuration, the layers constituting the laminated body can be respectively employed in accordance with use applications and functions. Accordingly, it is possible to obtain a low-profile liquid droplet ejecting head. As a result, when a printing apparatus has the liquid droplet ejecting head, this contributes to a decrease in size of the printing apparatus.

Another aspect of the invention is directed to a printing apparatus including the liquid droplet ejecting head according to the above-mentioned aspect of the invention.

With this configuration, the printing apparatus includes the liquid droplet ejecting head capable of isolating the wiring pattern, which is provided inside the concave portion of the base substrate, from the outside. With such a configuration, by preventing corrosion, deterioration, and the like of the wiring pattern, it is possible to provide a printing apparatus which is excellent in reliability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid droplet ejecting head and a printing apparatus will be described in detail, on the basis of preferred embodiments of the invention, with reference to the accompanying drawings.

Figure 1:
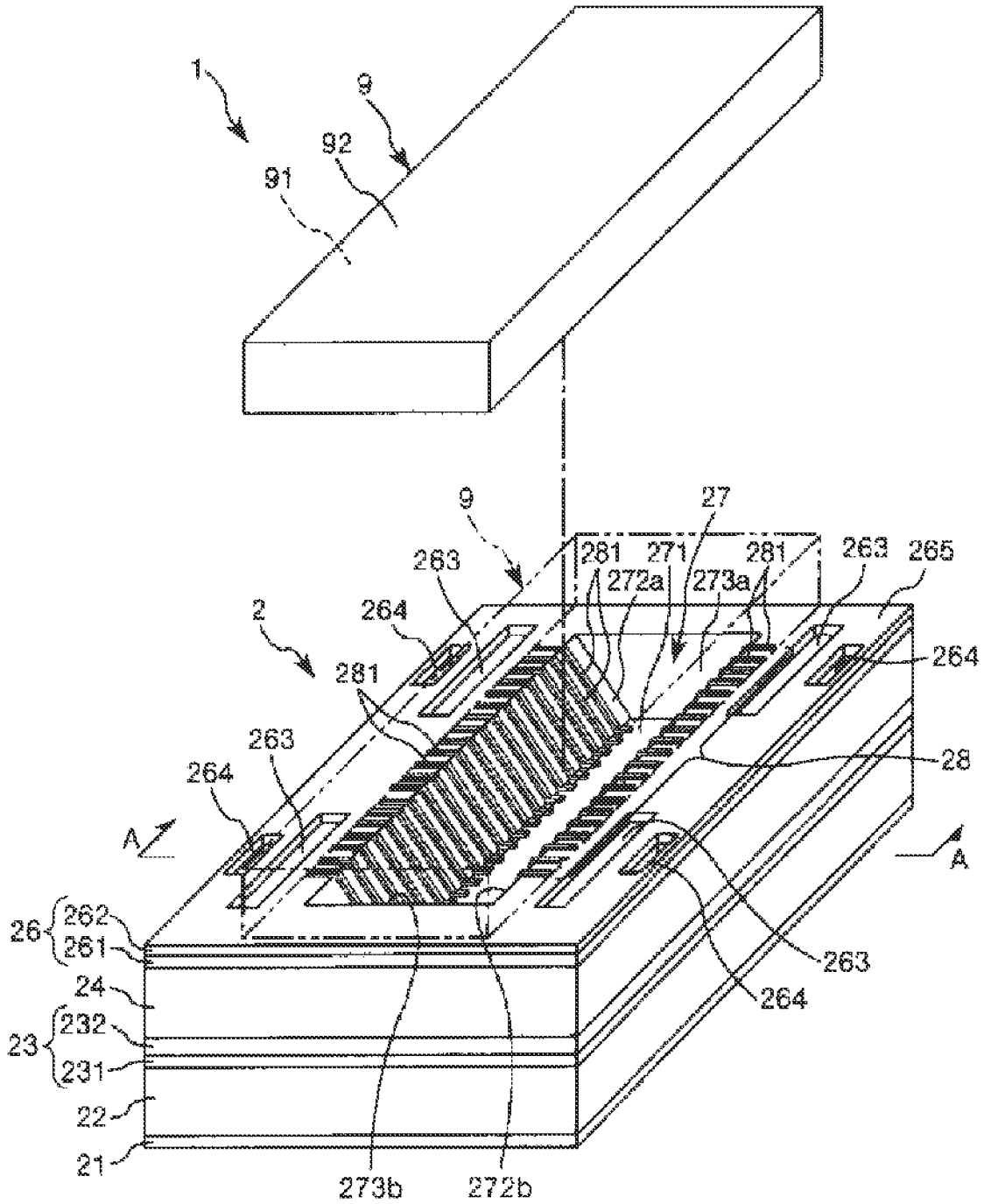
FIG. 1 is an exploded perspective view illustrating a liquid droplet ejecting head according to an embodiment of the invention.
Figure 2:
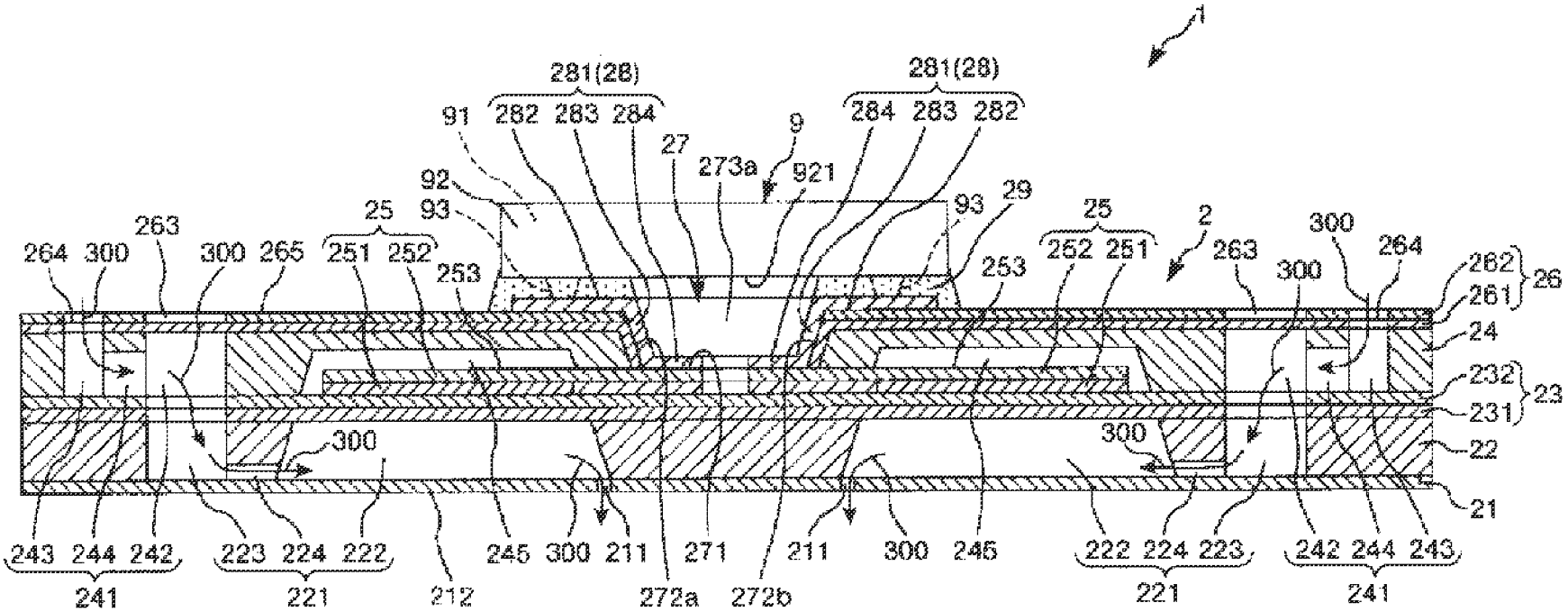
FIG. 2 is a cross-sectional view taken along the A-A line of FIG. 1.
Figure 3:
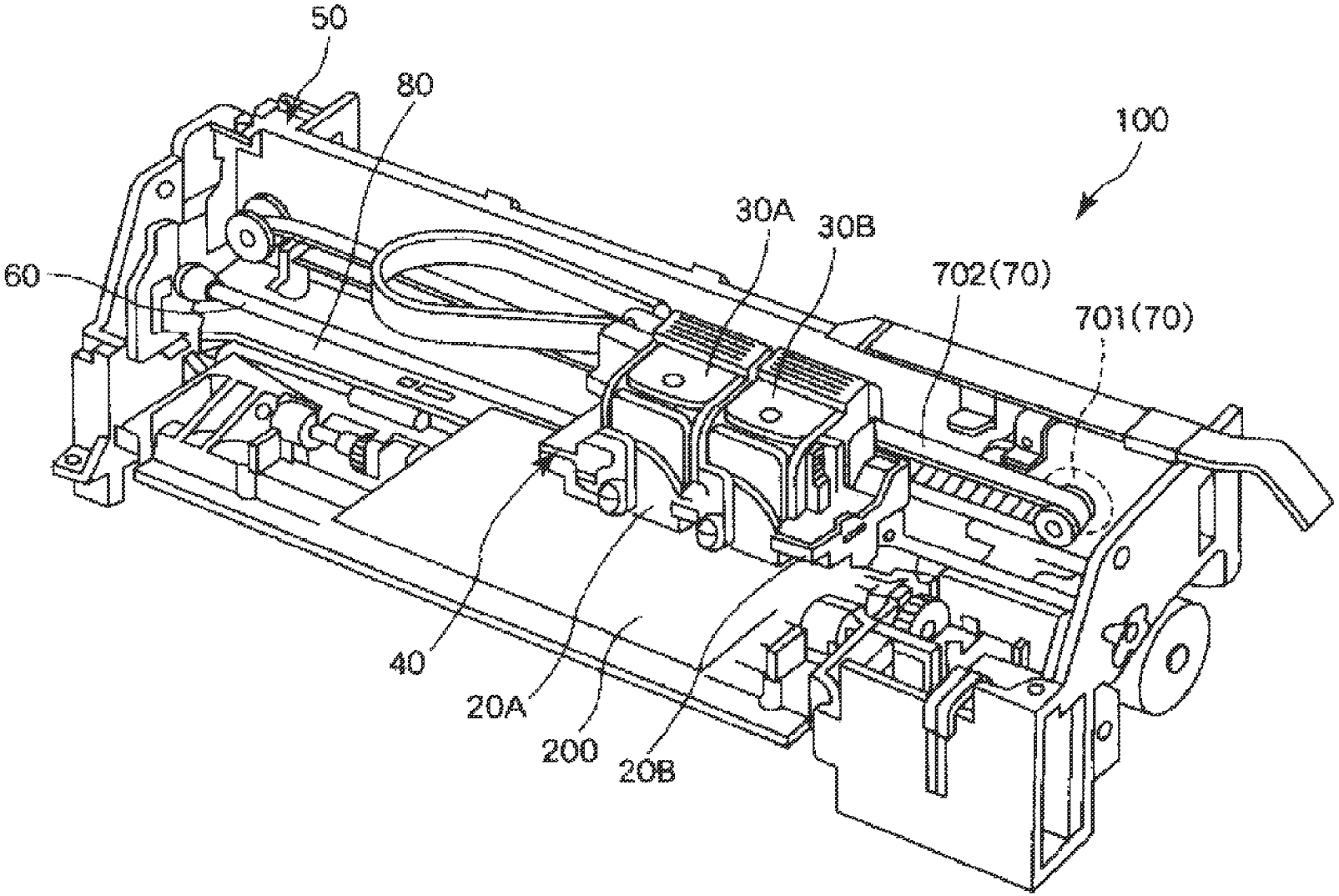
FIG. 3 is a perspective view illustrating a printing apparatus according to an embodiment of the invention.

FIG. 1 is an exploded perspective view illustrating a liquid droplet ejecting head according to an embodiment of the invention. FIG. 2 is a cross-sectional view taken along the A-A line of FIG. 1. FIG. 3 is a perspective view illustrating a printing apparatus according to an embodiment of the invention. It should be noted that, hereinafter, for convenience of description, in FIGS. 1 to 3, the upper side is referred to as "up" or "above", and the lower side is referred to as "down" or "under".

A liquid droplet ejecting head 1 shown in FIGS. 1 and 2 includes a base substrate 2, which is formed as a plate-like body, and an IC (Integrated Circuit) package 9 which is disposed on the base substrate 2. As described later, the liquid droplet ejecting head 1 is mounted in a printing apparatus (liquid droplet ejection apparatus) 100, and ejects an ink 300 as liquid droplets onto a printing medium 200 such as a printing paper, thereby performing printing on the printing medium 200 (refer to FIG. 3). It should be noted that the IC package 9 includes IC chips (connection-bump-added IC chip) and the like.

As shown in FIG. 1, the base substrate 2 is formed in a rectangular shape in plan view. As shown in FIGS. 1 and 2, the base substrate 2 has a nozzle substrate (nozzle plate) 21, a flow passage formation substrate 22, a vibration plate 23, a reservoir formation substrate (protective substrate) 24, and a compliance substrate 26. In addition, the base substrate 2 is formed as a laminated body in which the above-mentioned components are laminated from the lower side in this order. In addition, the substrates constituting the base substrate 2 are bonded to each other through, for example, an adhesive, a thermal adhesion film, or the like.

As described above, since the base substrate 2 is formed as a laminated body, the layers constituting the laminated body can be respectively employed in accordance with use applications and functions. Thereby, it is possible to obtain the low-profile liquid droplet ejecting head 1, and this contributes to a decrease in size of the printing apparatus 100.

As shown in FIG. 2, the nozzle substrate 21 has a plurality of ejection ports (nozzle openings) 211 which are formed through the nozzle substrate 21, that is, formed to be open toward the lower surface (the other surface) 212 of the base substrate 2 (plate-like body). Such ejection ports 211 are arranged in a matrix. In the embodiment, the ejection ports 211 are arranged in n rows (n is an integer not less than 1) in the length direction (long side direction) of the base substrate 2 and in two columns in the width direction (short side direction).

In addition, it is preferable that each ejection port 211 be provided with a coating layer with water repellency. Thereby, the liquid droplets, which are ejected from the ejection ports 211, drop downward as vertically as possible, and can be reliably landed at landing target positions on the printing medium 200.

Further, a constituent material of the nozzle substrate 21 is not particularly limited, and it is preferable that the material be, for example, silicon material or stainless steel. Such a material is excellent in chemical resistance. Thus, even during exposure of the ink 300 over a long period of time, the nozzle substrate 21 can be reliably prevented from changing in quality and deteriorating. Furthermore, such a material is excellent in processability, and thus it is possible to obtain the nozzle substrate 21 with high dimensional accuracy. Hence, it is possible to obtain the liquid droplet ejecting head 1 with high reliability.

Flow passages 221, through which the ink 300 is sent to the respective ejection ports 211, are formed on the flow passage formation substrate 22. The flow passages 221 are formed by performing, for example, etching. As shown in FIG. 2, each flow passage 221 can be divided into a pressure generation chamber 222, a relay chamber (communication portion) 223, and a communication passage (supply passage) 224 through which the pressure generation chamber 222 communicates with the relay chamber 223.

The pressure generation chamber 222 is provided to correspond to each ejection port 211, and communicates with the outside through the ejection port 211.

The relay chamber 223 is provided upstream of the pressure generation chamber 222.

The communication passage 224 is provided between the pressure generation chamber 222 and the relay chamber 223.

In addition, the constituent material of the flow passage formation substrate 22 is not particularly limited, and may employ, for example, the same constituent material as the nozzle substrate 21.

The vibration plate 23 may be vibrated in the thickness direction by driving of the piezoelectric elements 25 to be described later. Further, some parts of the vibration plate 23 face the pressure generation chambers 222. Then, by vibrating the vibration plate 23, the pressures within the pressure generation chambers 222 are changed, and the ink 300 can be ejected as liquid droplets through the ejection ports 211 from the pressure generation chambers 222.

Such a vibration plate 23 is formed by laminating an elastic film 231 and a lower electrode film 232 in order from the flow passage formation substrate 22 side. The elastic film 231 is formed of a silicon oxide film with a thickness of, for example, about 1 to 2 μm. The lower electrode film 232 is formed of a metal film with a thickness of, for example, about 0.2 μm. The lower electrode film 232 functions as a common electrode of the plurality of piezoelectric elements 25 which are disposed between the flow passage formation substrate 22 and the reservoir formation substrate 24.

In the reservoir formation substrate 24, the reservoirs 241, which temporarily store the ink 300, are formed to respectively communicate with the flow passages 221 of the flow passage formation substrate 22. As shown in FIG. 2, each reservoir 241 can be divided into a first chamber (reservoir section) 242, a second chamber (injection passage) 243, and a communication passage 244 through which the first chamber 242 communicates with the second chamber 243.

The first chambers 242 are positioned above the relay chambers 223 of the flow passages 221 of the flow passage formation substrate 22. In addition, the parts of the vibration plate 23 between the first chambers 242 and the relay chambers 223 are penetrated. Thereby, each first chamber 242 communicates with each relay chamber 223.

The second chamber 243 is provided upstream of the first chamber 242.

The communication passage 244 is provided between the first chamber 242 and the second chamber 243.

It should be noted that, in the liquid droplet ejecting head 1, the relay chamber 223 may constitute a part of the reservoir 241.

Further, a piezoelectric element housing chambers 245, which respectively house the piezoelectric elements 25, is formed on the reservoir formation substrate 24. The piezoelectric element housing chamber 245 is formed separately from the reservoir 241.

Each piezoelectric element 25 is formed by laminating a piezoelectric body film (piezo element) 251 and an upper electrode film 252 in order from the lower electrode film 232 side. Then, when a voltage is applied between the upper electrode film 252 and the lower electrode film 232, the piezoelectric body film 251 is deformed by the piezoelectric effect. Due to the deformation, the vibration plate 23 is vibrated in the up and down direction. As described above, due to the vibration of the vibration plate 23, the pressure within the pressure generation chamber 222 is changed, whereby the ink 300 can be ejected as liquid droplets through the ejection port 211 from the pressure generation chamber 222. As described above, each piezoelectric element 25 is configured to eject the ink 300 (liquid droplets) from the ejection port 211 through the vibration plate 23.

The compliance substrate 26 is formed by laminating a sealing film 261 and a fixing plate 262 in order from the reservoir formation substrate 24 side. The sealing film 261 is formed of a material (for example, a polyphenylene sulfide film with a thickness of about 6 μm) with flexibility. Some parts of the sealing film 261 face the reservoirs 241. Further, the fixing plate 262 is formed of a relatively hard material (for example, stainless steel with a thickness of about 30 μm) such as a metal material. It is preferable that absent portions 263 as vacant parts be formed on the parts of the fixing plate 262 facing the reservoir 241 side.

Further, injection ports 264, which penetrate through the sealing film 261 and the fixing plate 262, are formed on the compliance substrate 26. Each injection port 264 communicates with each reservoir 241 so as to inject the ink 300 into the reservoir 241.

As shown in FIGS. 1 and 2, a concave portion 27, which is open toward the central portion of an upper surface (one surface) 265, is formed on the base substrate 2 formed as the above-mentioned laminated body. As shown in FIG. 2, the concave portion 27 is formed by performing, for example, etching in the range from the upper surface 265 to the upper surface 253 of the upper electrode film 252 of the piezoelectric elements 25.

Further, the concave portion 27 is formed in a shape of a channel along the length direction of the base substrate 2. Thereby, multiple (plural) linear portions (linear objects) 281, which constitute a wiring pattern 28 electrically connected to the IC package 9 to be described later, can be arranged along the length direction of the concave portion 27 (channel) (refer to FIG. 1). Consequently, the IC package 9, which is capable of transmitting and receiving a large volume of information through the linear portions 281, can be mounted on the base substrate.

The concave portion 27, which is formed as described above, includes a bottom portion 271, first side wall portions 272*a* and 272*b*, and second side wall portions 273*a* and 273*b*. The first side wall portions 272*a* and 272*b* stand on the bottom portion 271, and are opposed to each other in a width direction of the concave portion 27 (channel). The second side wall portions 273*a* and 273*b* stand on the bottom portion 271, and are opposed to each other in the length direction of the concave portion 27.

The bottom portion 271 is a planar portion.

The first side wall portions 272*a* and 272*b* are inclined to the bottom portion 271. Further, the separation distance between the first side wall portions 272*a* and 272*b* gradually increases toward the upper surface 265 side.

As described above, the first side wall portions 272*a* and 272*b* are inclined. Thus, the concave portion 27 can be easily and reliably formed by, for example, etching.

The second side wall portions 273*a* and 273*b* stand upright on the bottom portion 271.

As shown in FIGS. 1 and 2, the wiring pattern 28 is provided inside the concave portion 27. The wiring pattern 28 is formed of a conductive material. The material is not particularly limited, and may employ a metal material with a relatively small electric resistance such as gold or copper.

The wiring pattern 28 is formed of multiple linear portions 281 each of which has a linear shape. Such linear portions 281 are arranged to be distributed on the first side wall portion 272*a* side and the first side wall portion 272*b* side, and are formed along a direction of inclination. In addition, the multiple linear portions 281, which are present on the first side wall portion 272*a* side, are separated from the multiple linear portions 281, which are present on the first side wall portion 272*b* side, in the width direction of the base substrate 2. Further, the adjacent linear portions 281, which are present on the first side wall portion 272*a* side, are separated from each other in the length direction of the base substrate 2. Furthermore, the adjacent linear portions 281, which are present on the first side wall portion 272*b* side, are separated from each other in the length direction of the base substrate 2.

Further, each linear portion 281 is formed to extend from the upper surface 265 of the base substrate 2 to the bottom portion 271 of the concave portion 27. Each linear portion 281 can be divided into an upper portion 282 which is formed on the upper surface 265, an intermediate portion 283 which is formed on the first side wall portion 272*a* (or first side wall portion 272*b*), and a lower portion 284 which is formed on the bottom portion 271 (refer to FIG. 2).

In the liquid droplet ejecting head 1, the wiring pattern 28 is formed of the multiple linear portions 281 as described above. Thereby, as the IC package 9 mounted on the base substrate 2, it is possible to employ an IC package capable of transmitting and receiving a large volume of information through the linear portions 281.

As shown in FIG. 2, the IC package 9 (or IC chip (connection-bump-added IC chip)) has an electronic circuit (semiconductor element) 91, a casing (package) 92 that houses the electronic circuit 91, and a plurality of terminals 93 that projects from the casing 92 and is electrically connected to the electronic circuit 91.

The electronic circuit 91 is formed of, for example, semiconductors.

The casing 92 is formed in a chip shape, and is able to house the electronic circuit 91 therein. The constituent material of the casing 92 is not particularly limited. For example, the material includes various resin materials, various metal materials, ceramics, or the like.

The number of the arranged terminals 93 is the same as the number of the linear portions 281 constituting the wiring pattern 28. In addition, each terminal 93 comes into contact with the upper portion 282 of the linear portion 281 corresponding to the terminal 93. Thereby, the electronic circuit 91 (IC package 9) is electrically connected to the wiring pattern 28 through the terminals 93. In addition, the constituent material of the terminal 93 is not particularly limited, and may employ a metal material with a relatively small electric resistance such as gold or copper.

The IC package 9 having such a configuration is electrically connected to the piezoelectric elements 25 through the wiring pattern 28. In addition, the IC package 9 controls an operation of each piezoelectric element 25. Thereby, it is possible to precisely and reliably eject the ink 300.

As shown in FIGS. 1 and 2, in the liquid droplet ejecting head 1, the IC package 9 is fixed to airtightly seal the inside of the concave portion 27 on the upper surface 265 side of the base substrate 2. Here, "airtightly" means a situation in which communication between the inside of the concave portion 27 and the outside is blocked. That is, "airtightly" means a situation in which gas, liquid, or the like is prevented from exchanging between the inside of the concave portion 27 and the outside.

Further, the IC package 9 has a size capable of covering the concave portion 27 in plan view. That is, the total length of the IC package 9 is greater than the total length of the concave portion 27, and the width of the IC package 9 is greater than the maximum width of the concave portion 27.

Furthermore, as a method of fixing the IC package 9 onto the base substrate 2, the configuration shown in FIG. 2 uses an adhesion method using an adhesive 29. A gap between the upper surface 265 of the base substrate 2 and a lower surface 921 (a surface facing the upper surface 265) of the casing 92 of the IC package 9 is filled with the adhesive 29. In addition, in a part of the upper surface 265 where the upper portions 282 of the linear portions 281 are formed, the upper portions 282 are bonded to the lower surface 921 of the casing 92 through the adhesive 29. Due to the adhesive 29, the gap between the IC package 9 and the base substrate 2 can be reliably filled. Consequently, it is possible to more reliably airtightly seal the inside of the concave portion 27.

It should be noted that the adhesive 29 may have a function of electrically connecting the upper portions 282 of the wiring pattern 28 to the terminals 93 of the IC package 9.

Due to the IC package 9 which is airtightly fixed as described above, it is possible to reliably prevent not only moisture (vapor) but also grit and dust from entering into the concave portion 27 from the outside. Thereby, it is possible to isolate and protect the wiring pattern 28, which is provided inside the concave portion 27, from the outside. Consequently, it is possible to prevent corrosion, deterioration, and the like of the wiring pattern 28.

Further, the IC package 9 also functions as a sealing member that seals the inside of the concave portion 27. Therefore, it is possible to omit providing a separate sealing member or coating the wiring pattern 28. Thereby, it is possible to simplify the structure of the liquid droplet ejecting head 1.

Next, the printing apparatus 100 having the liquid droplet ejecting head 1 will be described.

The printing apparatus 100 shown in FIG. 3 is a printing apparatus that performs printing on the printing medium 200 in an ink jet method. The printing apparatus 100 includes: an apparatus main body 50, printing head units 20A and 20B on which the liquid droplet ejecting head 1 is mounted; ink cartridges 30A and 30B that supply the ink 300; a carriage 40 that transports the printing head units 20A and 20B; a moving mechanism 70 that moves the carriage 40; and a carriage shaft 60 that movably supports (guides) the carriage 40.

The ink cartridge 30A is detachably mounted on the printing head unit 20A, and is able to supply the ink 300 (black ink composition) to the printing head unit 20A in the mounting state.

The ink cartridge 30B is also detachably mounted on the printing head unit 20B, and is able to supply the ink 300 (color ink composition) to the printing head unit 20B in the mounting state.

The moving mechanism 70 has a driving motor 701 and a timing belt 702 which is connected to the driving motor 701. Then, a driving force (torque) of the driving motor 701 is transferred to the carriage 40 through the timing belt 702, whereby it is possible to move the carriage 40 along the direction of the carriage shaft 60 together with the printing head units 20A and 20B.

Further, in the apparatus main body 50, a platen 80 is provided on the lower side of the carriage shaft 60 along the shaft direction. The printing medium 200, which is fed by a sheet feeding roller not shown in the drawing, is transported onto the platen 80. Then, the ink 300 is ejected onto the printing medium 200 on the platen 80, thereby performing printing.

The above description was given of the liquid droplet ejecting head and the printing apparatus according to the embodiments of the invention shown in the drawings. However, the invention is not limited to the embodiments. For example, each portion, which constitutes the liquid droplet ejecting head and the printing apparatus, can be replaced with an arbitrary component capable of exhibiting the same function. Further, an arbitrary component may be added.

Further, an outlet for communicating with the concave portion may be provided on the base substrate. In a process of manufacturing the liquid droplet ejecting head, it is possible to discharge air within the concave portion to the atmosphere through the outlet. It should be noted that the outlet is sealed after completion of the manufacture of the liquid droplet ejecting head.

Furthermore, a marker for positioning the IC package such that the IC package reliably covers the concave portion may be added to the base substrate.

Moreover, in the embodiment, the liquid droplet ejecting head (printing apparatus) is configured so as to eject the ink as liquid droplets onto the printing medium such as the printing paper, thereby performing printing. The invention is not limited to this. For example, a liquid crystal display device (LCD device) may be manufactured by ejecting a material, which is for forming the liquid crystal display device, as liquid droplets. Alternatively, an organic electro luminescence display device (organic EL device) may be manufactured by ejecting a material, which is for forming the organic EL device, as liquid droplets. Alternatively, a circuit substrate may be manufactured by ejecting a material, which is for forming the wiring pattern, as liquid droplets so as to form the wiring pattern of an electronic circuit.

What is claimed is:

1. A liquid droplet ejecting head comprising:

a base substrate that is formed as a plate-like body and that has a concave portion, which is formed to be open toward one surface of the plate-like body, and a wiring pattern which is provided inside the concave portion and formed of a conductive material; and an IC package that is electrically connected to the wiring pattern, wherein the IC package has a planar shape, wherein the IC package seals and fixes the concave portion on the one surface side.

2. The liquid droplet ejecting head according to claim 1, wherein the IC package is formed in a chip shape, and has a size capable of covering the concave portion in plan view.

3. The liquid droplet ejecting head according to claim 2, wherein the IC package is fixed onto the base substrate through an adhesive, and wherein a gap between one surface of the base substrate and one surface of the IC package is filled with the adhesive.

4. A printing apparatus comprising the liquid droplet ejecting head according to claim 3.

5. A printing apparatus comprising the liquid droplet ejecting head according to claim 2.

6. The liquid droplet ejecting head according to claim 1, wherein the concave portion is formed in a shape of a channel, and has a bottom portion and a pair of side wall portions which stand on the bottom portion so as to be opposed to each other in a width direction of the channel.

7. The liquid droplet ejecting head according to claim 6, wherein the side wall portions are inclined such that a separation distance between the side wall portions gradually increases toward the one surface side.

8. The liquid droplet ejecting head according to claim 7, wherein the wiring pattern is formed of a plurality of linear objects formed to extend from the one surface to the bottom portion along directions of inclination of the side wall portions.

9. A printing apparatus comprising the liquid droplet ejecting head according to claim 8.

10. A printing apparatus comprising the liquid droplet ejecting head according to claim 6.

11. A printing apparatus comprising the liquid droplet ejecting head according to claim 7.

12. The liquid droplet ejecting head according to claim 1, wherein the base substrate has an ejection port, which is formed to be open toward the other surface of the plate-like body and ejects liquid droplets, and a piezoelectric element which causes the liquid droplets to be ejected from the ejection port, and wherein the IC package is electrically connected to the piezoelectric element through the wiring pattern so as to control an operation of the piezoelectric element.

13. A printing apparatus comprising the liquid droplet ejecting head according to claim 12.

14. The liquid droplet ejecting head according to claim 1, wherein the base substrate is formed as a laminated body.

15. A printing apparatus comprising the liquid droplet ejecting head according to claim 14.

16. A printing apparatus comprising the liquid droplet ejecting head according to claim 1.

* * * * *